US007140416B2

(12) United States Patent
Bassarutti et al.

(10) Patent No.: US 7,140,416 B2
(45) Date of Patent: Nov. 28, 2006

(54) CONTINUOUS METAL STRIP CASTING PLANT

(75) Inventors: Alfredo Bassarutti, Cargnacco (IT); Brian W. Botham, Retford (GB); Edi Faggiani, Udine (IT); Alfredo Poloni, Fogliano Redipuglia (IT); Miroslav Zerajic, Palmanova (IT); Nuredin Kapaj, Udine (IT)

(73) Assignee: Danieli & C. Officine Meccaniche S.p.A. (IT)

( * ) Notice: Subject to any disclaimer, the term of this patent is extended or adjusted under 35 U.S.C. 154(b) by 69 days.

(21) Appl. No.: 10/520,643

(22) PCT Filed: Jul. 9, 2003

(86) PCT No.: PCT/EP03/07430

§ 371 (c)(1),
(2), (4) Date: Jan. 6, 2005

(87) PCT Pub. No.: WO2004/007113

PCT Pub. Date: Jan. 22, 2004

(65) Prior Publication Data

US 2005/0115694 A1 Jun. 2, 2005

(30) Foreign Application Priority Data

Jul. 10, 2002 (IT) ..... MI2002A001510

(51) Int. Cl.
*B22D 11/10* (2006.01)

(52) U.S. Cl. ..... 164/428; 164/437

(58) Field of Classification Search ..... 164/428, 164/488, 437

See application file for complete search history.

(56) References Cited

U.S. PATENT DOCUMENTS 5,196,157 A * 3/1993 Inoue et al. ..... 266/143
5,228,498 A * 7/1993 Harada et al. ..... 164/488

FOREIGN PATENT DOCUMENTS

| | | | |
|---|---|---|---|
| DE | 10057876 | | 5/2002 |
| EP | 0 450 775 | A2 | 10/1991 |
| EP | 0 947 261 | A2 | 10/1999 |
| JP | 4-200961 | * | 7/1992 |
| JP | 63 35753 | | 12/1994 |
| JP | 10-5941 | * | 1/1998 |
| JP | 2001-219251 | * | 8/2001 |

* cited by examiner

*Primary Examiner*—Len Tran
(74) *Attorney, Agent, or Firm*—Stetina Brunda Garred & Brucker

(57) ABSTRACT

A continuous metal strip casting plant on which is mounted, at the casting location, a mobile ingot mould comprising two cylindrical metallic casting rolls in addition to other components, amongst which there are a tundish and/or under tundish and/or an unloader and/or lateral plates, respective preheating stations located in positions separated from the position of casting, and rotating arms located on a turret itself also placed on the casting plane to transfer the components from the casting line to their preheating stations.

11 Claims, 2 Drawing Sheets

CONTINUOUS METAL STRIP CASTING PLANT

FIELD OF THE INVENTION

The present invention relates to a plant for continuous casting of metal strip and more precisely it relates to a plant provided with automated means for assembling or replacing some of its parts.

STATE OF THE ART

Since some time the possibility has arisen of carrying out the continuous casting of metals directly in the shape of strips of indefinite length, only depending on the amount of molten metal both to be cast and actually cast, essentially with the aim of overcoming the technical, economic and environmental drawbacks associated with the casting of ingots or slabs of considerable thickness to be later transformed by means of hot and possibly cold lamination operations into strips having thicknesses ranging from a few millimetres (hot strips) to a few tens of millimetres (cold strips). Already used for some decades with the treatment of metals such as copper and aluminium, the continuous casting of metallic strips has been proposed for materials with high smelting points, in particular firstly for stainless steel and low carbon content steel and then for steels with high surface quality requirements such as stainless steels, with silicon for magnetic uses, etc. However, at the moment, technology is still at a pilot plant stage for these materials, due to the several difficulties, especially associated with the high smelting temperatures of said ferrous materials and to their relatively slow solidification, and the need to combine the characteristics of a strongly innovative process with the structure of more traditional collateral plants. For example, a problem still unresolved is that of guaranteeing the continuity of the process, in particular in view of the replacement of parts of the plant. In fact, as in many industrial processes also in the continuous casting of metallic strip the possibility of operating really continuously ensures notable technical and economical advantages. In this respect, it is extremely important to succeed in substituting, in the least amount of time possible, any component of the plant, i.e. both of the casting machine itself (groups containing the casting rolls which make up the ingot mould) and the refractory components (tundish, under-tundish, side plates, unload nozzle).

For example, in EP-A-450775 a continuous casting plant of a strip, also denominated "strip casting" from the English technical terminology, is described, in which the cooled casting rolls constituting the ingot mould are mounted on a mobile trolley on rails between a first mounting and standby station and a second casting station. The other components, such as the tundish and unloader, are heated in ovens arranged nearby the casting plane and transported to the mobile trolley suspended from a bridge crane.

EP-A-947261 describes a "strip casting" plant in which the cooled rolls constituting the ingot mould are mounted on a mobile trolley between a first position, below the casting plane, and a second position on the casting plane. This document describes the means for mounting the rolls on the trolley and the means for adjusting them; no details on the other components are given, such as the tundish and the unloader, in particular regarding their preheating and their transportation from the heating station to that of the casting.

The Japanese published patent application JP-A-6-335753 describes a "strip casting" plant in which the rolls constituting the ingot mould are changed, in case of necessity, by means of a bridge crane.

In summary, in the previous technical literature examined are used, next to a sophisticated plant at very high productivity such as that of "strip casting", traditional machinery such as bridge cranes which require manual interventions for the attachment and detachment of the components to transport and present somewhat long completion times.

DESCRIPTION OF THE INVENTION

According to the present invention, a continuous casting plant of a metallic strip is disclosed, said casting plant comprising a casting plane, a casting station and a plurality of further stations substantially separated from said casting station and, in said casting station, a mobile ingot mould comprising two cylindrical, cooled, counter-rotating rolls and two plates each of which is set at the ends of said rolls, to close at the sides of said rolls the space between them, said rolls defining, between their respective facing surfaces, a space inside which molten metal is cast and solidifies upon contact with the surface of said rolls and is then extracted from below as a hot metal strip, and said continuous casting plant further comprising a plurality of further component elements, treatment stations for said additional component elements, and moving means for moving each of said additional component elements, wherein said treatment stations are all set on the casting plane, said further component elements being moved between their respective treatment stations and said casting station by rotating arms located on at least one turret, said turret being set on the casting plane.

Preferred embodiments provide for two of such turrets each of which being located close to one side of the casting station.

Two additional minor turrets are placed alongside the casting station, parallel with the vertical casting plane.

Said additional component elements moved by rotating arms are: a ladle, at least one tundish and/or at least one under-tundish, and/or at least one molten metal distributor within said space between counter-rotating rolls, and/or the two side plates which rest at the flat ends of said rolls, to laterally close the space between the rolls.

Said turrets are each provided with two arms, one suitable to move the tundish and the other one suitable to move the under-tundish from the respective treatment stations (maintenance, preheating, . . . ), arranged near to the turrets within the reach of said arms, and the casting station.

The additional turrets carry robotic arms for moving said molten metal distributor, and said lateral plates of the respective treatment stations (maintenance, preheating, . . . ) to the casting station; they are located nearby the casting station, on a plane parallel to that containing the cast strip.

The casting rolls are arranged within a trolley which can move trasversally to the direction of casting between a treatment position (maintenance, mounting, regulation, . . . ) and the casting station, said trolley being provided with means to set and hold in position the rolls and to regulate their gap with the aim of controlling the thickness of the cast strip. The motor necessary to set the rolls in rotation during casting is fixed on the casting plane and is automatically coupled to the system located on the trolley for the synchronous rotation of the rolls.

The casting plane is also provided with a rail, parallel to the axis of rotation of the rolls, on which said trolley moves between the casting station and a treatment station for the rolls (maintenance, mounting on the trolley, adjusting the mutual positions, . . . ).

The casting plane also carries a tower (ladle tower) to put the ladle in the casting station, preferably arranged in a central position with respect to the turret for the movement of the tundish and under-tundish.

On the casting plane means for collecting wastes of slag and of metal and means for movement thereof are also provided.

A preferred mode of working of said plant is described herein as follows. At the start of the casting process, tundish and under-tundish, metal distributor and side plates are all in their respective preheating positions near to the turrets for their moving. The casting rolls, arranged on a mobile trolley, are in their treatment station, which comprises means for moving the trolley from the position of mounting of the rolls to a standby position. Such means of movement can consist of a carriage containing two trolleys, one ready to be sent to the casting station and the other waiting to be sent to the position for mounting and adjusting the rolls. In the meantime molten metal is loaded into the ladle, which is transported nearby the ladle tower, held by an appropriate arm of the latter and carried to the casting station. Contemporarily, the tundish and possibly the under-tundish, for the plants in which this is envisaged, are set in their positions in the casting station, each moved by one of the arms of said tundish rotating towers; it is to note that for greater flexibility of use and to overcome possible mechanical inconveniences, the tundish and under-tundish to be placed in the casting station can be moved by the respective arms of the same turret or a tundish by one turret and an under-tundish by another. Whilst the tundish is being filled with molten metal from the ladle, first the distributor and then the containment plates are brought to the casting station. Immediately afterwards, it is possible to begin the casting.

In such a way, it is possible to realise the simultaneous movement of many of the above described components from the respective preheating stations to the respective casting station, significantly reducing the accumulated time of setting in motion, or however of the movement of any one of said components in the case of replacement during the execution of the casting.

In purely indicative and non limiting terms, one can say that during the simulation of functioning, transfer times of the unloader and side plates of even less than a minute have been obtained, whilst for tundishes and under-tundishes maximum times of less than three minutes have been obtained, whilst for the casting rolls, mounted on the supporting trolley, it has never been above five minutes.

DESCRIPTION OF THE DRAWINGS

The present invention will now be described in relation to the enclosed drawings, in which a possible embodiment of the same is shown by way of a non-limiting example of the objects and scope of the invention.

In FIG. 1, a ladle 1 is shown in working position and communicating with a tundish 3 through an unloader 2; from the tundish 3 the molten metal passes, with a flow controlled by the rod 4, or through a slide gate or slide valve or other equivalent device, through the chamber 5, which protects the metal cast from oxidation, within an optional under-tundish, not shown, or directly into a distributor 7. Obviously, the plug rod can be replaced with other suitable means, for example a sliding gate nozzle ladle. In the embodiment not provided with the under-tundish, the molten metal which flows inside the distributor unloader 7 is distributed within the space existing between the two rolls 8, 8', arranged in the container trolley 9 sliding on rails. The trace of the strip 15 leaving the ingot mould is shown. As can be seen, the tundish 3 is supported by an arm 12 of a tundish rotating turret 10, the other arm of which 11 holds the under-tundish 6. On the casting plane 16 a mechanical robotic arm 13 is also arranged which moves the distributor unloader 7, and side plates of known type, and not shown in the figures, from the respective heating positions to the casting positions.

Figure 1:
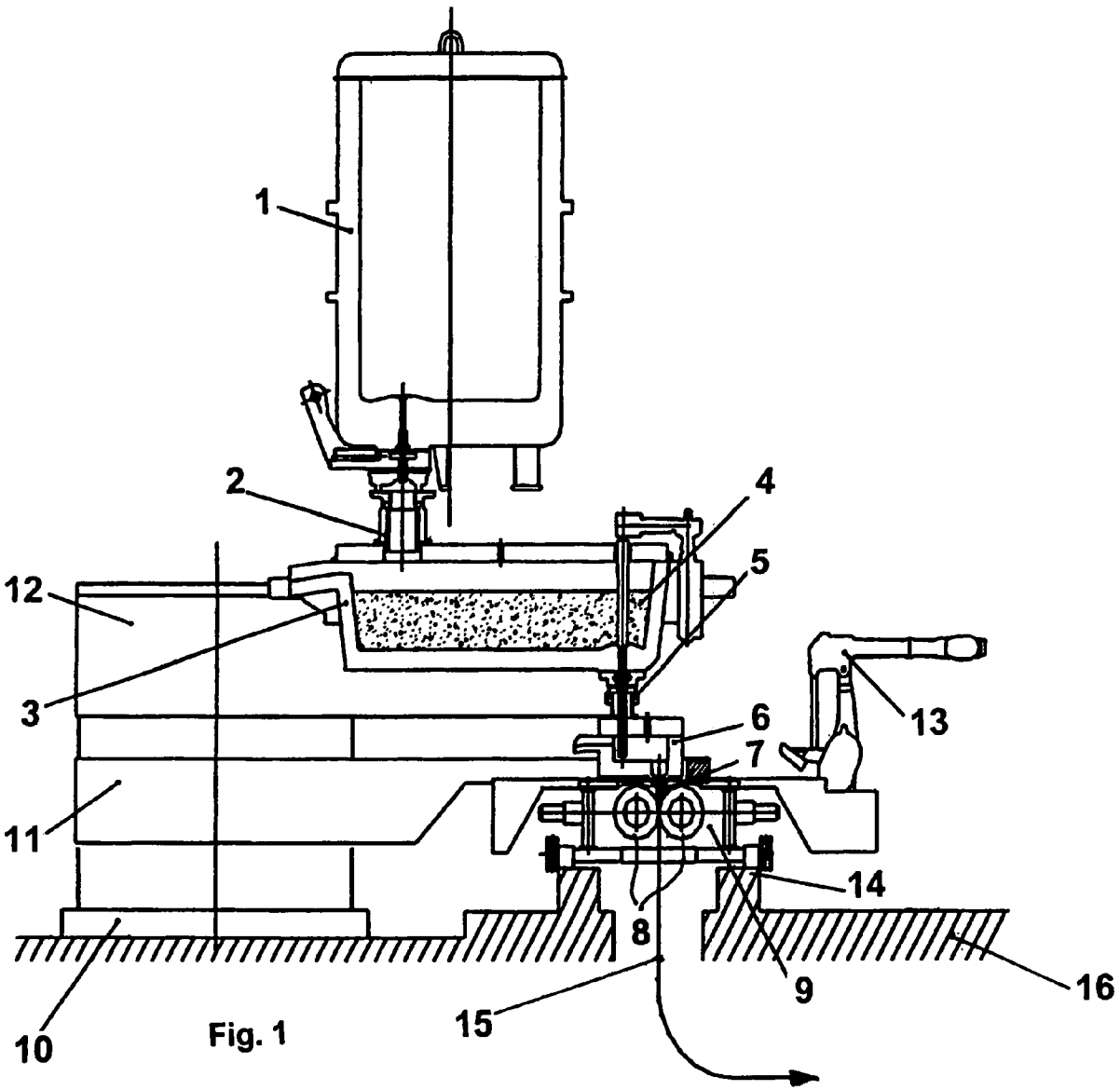
FIG. 1 shows schematically a partially sectional side view of a plant according to the present invention.
Figure 2:
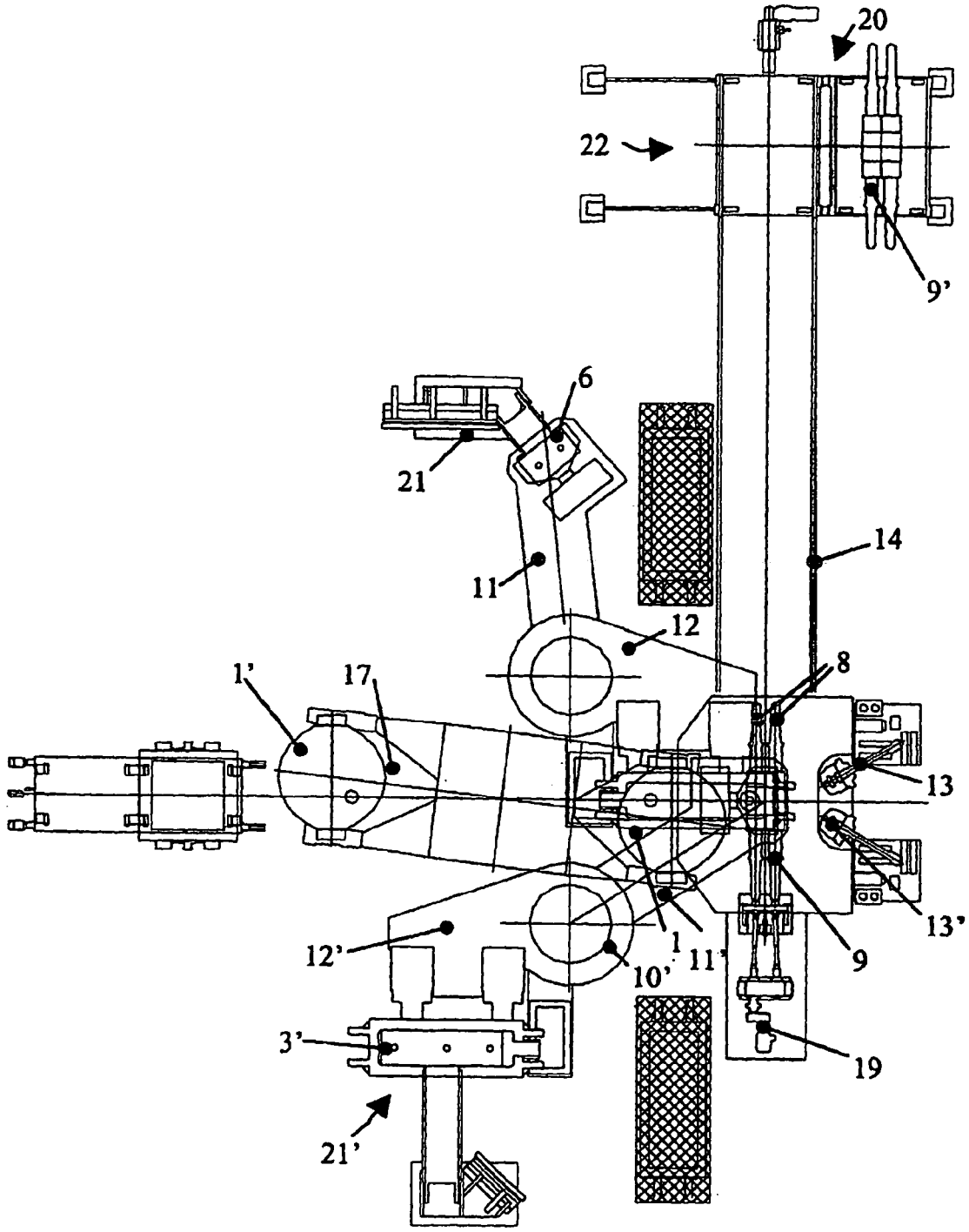
FIG. 2 schematically shows a plan view of the plant of FIG. 1.

Now referring to FIG. 2, the distribution on the casting plane of the various parts of the plant can be better appreciated. In particular it can be seen how the ladle turret 17 has two arms in line, one of which carries the ladle 1 to the casting station 25, whilst the other arm hold a ladle 1' in standby. The turret 10 has an arm 12 which in its turn supports a tundish, not shown in this plan view, in the casting station, whilst the other arm 11 supports the under-tundish 6 heating in the station 21. A second tundish rotating turret 10' has in its turn an arm 12' supporting the tundish 3' which is heated in the station 21', whilst the other arm 11' holds an under-tundish (not shown) in the casting station. Adjacent to the casting station 25, in which the mobile trolley 9 is situated holding the rolls 8 therein.—The rotation of said rolls is driven by the motorised assembly 19—the heating ovens 18 and 18' for the unloader and side plates are positioned, which are movable between heating positions and casting station by means of the relative robotic arms 13 and 13'.

The trolley 9 moves along the rails 14 between the casting station and its treatment station 20, in which a second trolley 9' is placed, in standby. The changeover between the trolleys can take place, as shown in FIG. 2, by means of a carriage 24 holding both the trolleys 9 and 9', and moving perpendicularly to the rails 14 between position 22 and the station 20. The trolley 9, arriving from the casting station 25, is positioned on the carriage, next to the trolley 9' which is found in position 22. The carriage 24 is then moved to put the trolley 9 in the station 20 and the trolley 9' on the rails. The carriage 24, at this point, is lowered, bringing the trolley 9' on the rails 14 and depositing the other trolley in the station 20. After that, the trolley 9' is sent to the casting station.

It is possible to use other methods for the changeover of the trolleys 9 and 9' in the casting station 25. For example, it is possible to locate, around the casting rolls treatment station 20, two couples of rails which lead by a suitable junction to the rails 14, so that the two trolleys 9 ad 9' can move independently, so that as soon as one of the trolleys is moved from the casting station to the treatment station on the first of said couple of rails, the other trolley can immediately move in starting from the second couple of rails.

The movement of all the components is automated, there is no need to intervene manually to attach or fix the moving parts and the most important and delicate parts move with simple rotational swinging movements. The movements are therefore easily executable in a really short time.

The invention claimed is:

1. A continuous casting plant of a metallic strip comprising a casting plane, a casting station and a plurality of further stations substantially separated from said casting station and, in said casting station, a mobile ingot mould comprising two cylindrical, cooled, counter-rotating rolls and two plates each of which is set at the ends of said rolls, to close at the sides of said rolls the space between them, said rolls defining, between their respective facing surfaces, a space inside which molten metal is cast and solidifies upon contact with the surface of said rolls and is then extracted from below as a hot metal strip, said continuous casting plant further comprising:

at least one tundish and at least one under-tundish;

at least one turret set on the casting plane adjacent to a side of the casting station, said turrent having first and second pivoting arms;

preheating stations for preheating said tundish and/or under-tundish, the preheating stations being disposed on the casting plane adjacent to the turret within reach of said pivoting arms;

wherein the first and second pivoting arms are operative to traverse respective said tundish and said under-tundish from the pre heating stations to the casting station.

2. The plant according to claim 1, wherein there are provided two turrets located adjacent to one side of the casting station, one tundish, one replacement tundish, one undertundish and one replacement undertundish, and the pivoting arms of the turrets are operative to traverse the replacement tundish and replacement undertundish from the preheating station to the casting station after the tundish and under tundish are removed for maintenance.

3. The plant according to claim 1, wherein two additional turrets are placed adjacent to the casting station, on a plane parallel to the one containing the cast strip.

4. The plant according to claim 2, further comprising a ladle or an unloading device, and/or at least one molten metal distributor within said space between said counter-rotating rolls moved into a casting position by pivoting arms.

5. The plant according to claim 3, wherein the additional turrets are provided with robotic arms suitable to move said molten metal distributor nozzle and said lateral plates from their respective treatment stations to said casting station.

6. The plant according to claim 1, wherein the casting rolls are set in a transversally movable trolley suitable to slide transversally to the casting direction between a treatment station and said casting station, said trolley being provided with means to place and hold in position said rolls and to adjust the gap between them in order to control the thickness of the cast strip.

7. The plant according to claim 1, wherein the casting plane further comprises a tundish rotating turret suitable to put the ladle in casting position, said tundish rotating tower being preferably arranged in a central position with respect to the turrets for moving the tundish and under-tundish.

8. The plant according to claim 1, further comprising means for collecting wastes of slag and metal and means for movement thereof.

9. The plant according to claim 1, further comprising unloading device and plates preheating stations with electric resistances.

10. The plant according to claim 1, futher comprising unloading device and plates preheating stations with burners.

11. The plant according to claim 1, further comprising unloading device and plates preheating stations with microwaves.

* * * * *